US008677713B1

(12) United States Patent
Sheehy

(10) Patent No.: US 8,677,713 B1
(45) Date of Patent: Mar. 25, 2014

(54) EXTRUDED WALL PANEL SYSTEM AND METHOD OF FORMING

(71) Applicant: EPI 04, Inc., Tallahassee, FL (US)

(72) Inventor: Gregory R. Sheehy, Reedsville, WI (US)

(73) Assignee: EPI 04, Inc., Tallahassee, FL (US)

( * ) Notice: Subject to any disclaimer, the term of this patent is extended or adjusted under 35 U.S.C. 154(b) by 0 days.

(21) Appl. No.: 13/786,846

(22) Filed: Mar. 6, 2013

(51) Int. Cl.
*E04B 2/00* (2006.01)
*E04H 1/00* (2006.01)

(52) U.S. Cl.
USPC ..... 52/588.1; 52/582.1; 52/586.2; 52/284; 52/286; 52/427; 52/429; 52/604; 52/605; 52/582

(58) Field of Classification Search
USPC ..... 52/282.1–282.3, 588.1, 582.1, 586.1, 52/583.1, 239, 238.1, 36.4, 36.6, 592.1, 52/288.1, 293.2, 427, 429, 782.1, 270, 52/578, 561, 569–571, 604–605, 599, 608, 52/580–581, 586.2; 160/135, 137, 351; 404/35, 41
See application file for complete search history.

(56) References Cited

U.S. PATENT DOCUMENTS 3,301,147 A * 1/1967 Clayton et al. ..... 404/35
3,562,992 A * 2/1971 kinsey ..... 52/588.1
4,557,091 A * 12/1985 Auer ..... 52/282.3
5,259,705 A * 11/1993 Breaux et al. ..... 405/267
5,491,943 A * 2/1996 Vondrejs et al. ..... 52/239
D371,208 S 6/1996 De Zen
D371,209 S 6/1996 De Zen
D371,210 S 6/1996 De Zen
D375,173 S 10/1996 De Zen
5,636,481 A 6/1997 De Zen
5,706,620 A 1/1998 De Zen
5,729,944 A 3/1998 De Zen
5,915,446 A 6/1999 De Zen
5,953,880 A 9/1999 De Zen
6,039,307 A 3/2000 De Zen
6,119,878 A 9/2000 De Zen
6,189,269 B1 2/2001 De Zen
6,195,953 B1 * 3/2001 Gitter et al. ..... 52/843
6,212,845 B1 4/2001 De Zen
6,253,527 B1 7/2001 De Zen
6,258,877 B1 7/2001 De Zen
6,412,227 B1 7/2002 De Zen
6,481,179 B2 11/2002 De Zen
D469,885 S 2/2003 De Zen
6,591,558 B1 7/2003 De Zen
6,679,310 B2 1/2004 De Zen
(Continued)

*Primary Examiner* — Jeanette E. Chapman
(74) *Attorney, Agent, or Firm* — Andrus Intellectual Property Law, LLP

(57) ABSTRACT

A wall member useful in forming a wall panel system includes a pair of outer walls held spaced apart and fixed together at a pair of opposed side edges, one of the side edges being provided with a first connecting structure and the other of the side edges being provided with a second connecting structure. The first and second connecting structure includes a number of projections secured to and extending outwardly from the side edges and constructed with snap fit elements separately located from the outer walls. The wall member is adapted to be joined to an adjacently disposed wall member of similar structure by direct snap fit mating engagement between one of the first and second connecting structure at one of the second edges of the wall member and the other of the first and second connecting structure on a facing side edge of the adjacently disposed wall member.

27 Claims, 9 Drawing Sheets

(56) References Cited

U.S. PATENT DOCUMENTS

| | | | | |
|---|---|---|---|---|
| 6,872,434 | B2 | 3/2005 | De Zen | |
| 6,889,475 | B2 | 5/2005 | De Zen | |
| 7,628,000 | B2 * | 12/2009 | Kahl | 52/588.1 |
| D619,879 | S | 7/2010 | McCarthy et al. | |
| 8,061,103 | B2 * | 11/2011 | McMahon | 52/582.2 |
| 2001/0003889 | A1 | 6/2001 | De Zen | |
| 2002/0124494 | A1 | 9/2002 | De Zen | |
| 2003/0000656 | A1 | 1/2003 | De Zen | |
| 2004/0074158 | A1 | 4/2004 | De Zen | |
| 2004/0081786 | A1 | 4/2004 | De Zen | |
| 2010/0096608 | A1 | 4/2010 | McCarthy et al. | |
| 2011/0045250 | A1 | 2/2011 | De Zen | |
| 2011/0258943 | A1 | 10/2011 | De Zen et al. | |

* cited by examiner

EXTRUDED WALL PANEL SYSTEM AND METHOD OF FORMING

BACKGROUND

The present disclosure relates generally to an extruded wall panel system such as used in building construction. More particularly, the present disclosure pertains to the provision of extruded wall members configured with connecting structure for mating and locking engagement with similar adjoining extruded wall members so that they can be easily interconnected and maintained together in the erection of the structure desired.

It is well known to use extruded plastic structural wall members or extruded plastic wall panel systems to construct different types of wall structures used in various construction applications. Such wall members may have a solid construction or may be provided with ribs or webs that form hollow chambers adapted to receive concrete or other materials. These known systems typically include one or more slidable intermediary connectors that allow multiple wall members to be connected together in an end-to-end configuration generally without the need for tools and fasteners.

Known connectors take the form of elongated joiners or columns formed with flanges or lips which are adapted to slidably engage and seat in grooves constructed in the wall panels of adjoining wall members to form an interlock therewith. With this arrangement, exposed faces of the wall members are flush with exposed surfaces of the joiners or columns. Such connectors permit the wall members to be joined typically in a straight line or at a right angle.

While such wall panel systems have been commonly used, interconnection is problematical or difficult because the side edge portions of the adjoining wall members must first be aligned and properly spaced from one another after which the elongated connectors must be slidably engaged with the grooves on the wall members from the top ends thereof in a vertical motion.

Accordingly, it is desirable to overcome the shortcomings of known interconnected wall panel designs by providing a differently constructed wall panel system which permits a quick, simple and improved interlocking assembly of wall members without the use of tools and fasteners.

SUMMARY

The present disclosure relates to a wall member which is useful in forming a wall panel system. The wall member includes a pair of outer walls held spaced apart and fixed together at a pair of opposed side edges. One of the side edges is provided with a first connecting structure, and the other of the side edges is provided with a second connecting structure which is structurally different than the first connecting structure. The first and second connecting structure includes a number of projections secured to and extending outwardly from the side edges and constructed with snap fit elements separately located from the outer walls. The wall member is adapted to be joined to an adjacently disposed wall member of similar structure by direct snap fit mating engagement between one of the first and second connecting structure at one of the side edges of the wall member and the other of the first and second connecting structure on a facing side edge of the adjacently disposed wall member.

In the preferred embodiment, the first connecting structure is a male connecting structure, and the second connecting structure is a female connecting structure. The outer walls are held in spaced relationship by a series of spaced apart crosspieces extending across and defining internal chambers between the outer walls. The outer walls and the first and second connecting structure are preferably formed from extruded plastic. The first and second connecting structure extends vertically between top and bottom edges of the outer walls.

The first connecting structure includes a pair of spaced tubular projections that extend outwardly at the one side edge from a first end crosspiece joining the outer walls. The tubular projections have inner surfaces, outer edges and outer surfaces joined to each other, the outer surfaces being coplanar with external surfaces of the outer walls. The first connecting structure further includes a pair of grooved walls extending outwardly from the first end crosspiece and forming inwardly projecting depressions. Outer ends of the grooved walls are joined to inwardly extending U-shaped channels that have outwardly extending legs connected by an end wall extending generally to the first end crosspiece.

The second connecting structure includes a second pair of tubular projections that extend at the other side edge from a second end crosspiece joining the outer walls. The tubular projections have inner surfaces, outer edges and outer surfaces connected together, the outer surfaces being coplanar with external surfaces of the outer walls. A third pair of tubular projections extend outwardly from the second pair of tubular projections and have inner surfaces, outer edges and outer surfaces joined together. A fourth pair of tubular projections extend inwardly from the third pair of tubular projections and are formed with rear walls, outer surfaces, outer edges and grooved inner walls having inwardly extending nibs formed thereon. The second connecting structure also has outwardly extending U-shaped channels formed therein.

In one exemplary embodiment, the outer walls are flat between the opposed side edges. In another exemplary embodiment, the outer walls are each comprised of a first flat wall segment integrally joined to a second wall segment that is angled relative to the first wall segment. The first connecting structure and the second connecting structure are integrally formed at the opposed side edges, or are provided in the form of adapters which are separately connected at the opposed side edges.

The present disclosure further relates to a wall panel system that includes a first wall member and a second wall member. Both the first wall member and the second wall member commonly have a pair of outer walls held spaced apart and fixed together at a pair of opposed side edges. One of the side edges is provided with a male connecting structure and the other of the side edges is provided with a female connecting structure. The first wall member is positioned adjacent the second wall member such that with one pair of the side edges of the first and second wall members facing each other, one of the male and female connecting structure at the facing side edge of the first wall member is movable into direct snap fit mating engagement with the other of the male and female connecting structure on the facing side edge of the second wall member to form an interconnection between the first and second wall members.

The female connecting structure is constructed with nibs that are engageable in the snap fit engagement with walls of depressions formed in the male connecting structure. The interconnection formed by the engaged male and female connecting structure defines a passageway arrangement for receiving a locking bar structure to positively lock the first and second wall members together. The interconnection formed by the engaged male and female connecting structure is concealed from exterior surfaces of the connected first and second wall members, and lies completely between the connected first and second wall members.

The present disclosure also relates to a method of forming a wall panel system including the steps of providing a first wall member and a second wall member, both having a pair of outer walls held spaced apart and fixed together at a pair of opposed side edges with one of the side edges being provided with a male connecting structure and the other of the side edges being provided with a female connecting structure, the male and female connecting structure being constructed with snap fit elements separately located from the outer walls; positioning the first and second wall members adjacent each other such that one pair of the side edges of the first and second wall members face each other; and slidably forcing one of the male and female connecting structure at the facing side edge of the first wall member into direct snap fit mating engagement with the other of the male and female connecting structure on the facing side edge of the second wall member to form an interconnection between the first and second wall members.

The formed interconnection between the first and second wall members defines a passageway arrangement. The method also includes the step of inserting locking bar structure into the passageway arrangement to secure the formed interconnection between the first and second wall members. The outer walls of the first and second wall members are provided with a plurality of crosspieces which form internal chambers between the outer walls. The method further includes the step of adding a flowable material to at least one of the internal chambers after the first and second wall members are interconnected together.

BRIEF DESCRIPTION OF THE DRAWINGS

The best mode of carrying out the disclosure described herein below with reference to the following drawing figures.

DETAILED DESCRIPTION

Figure 1:
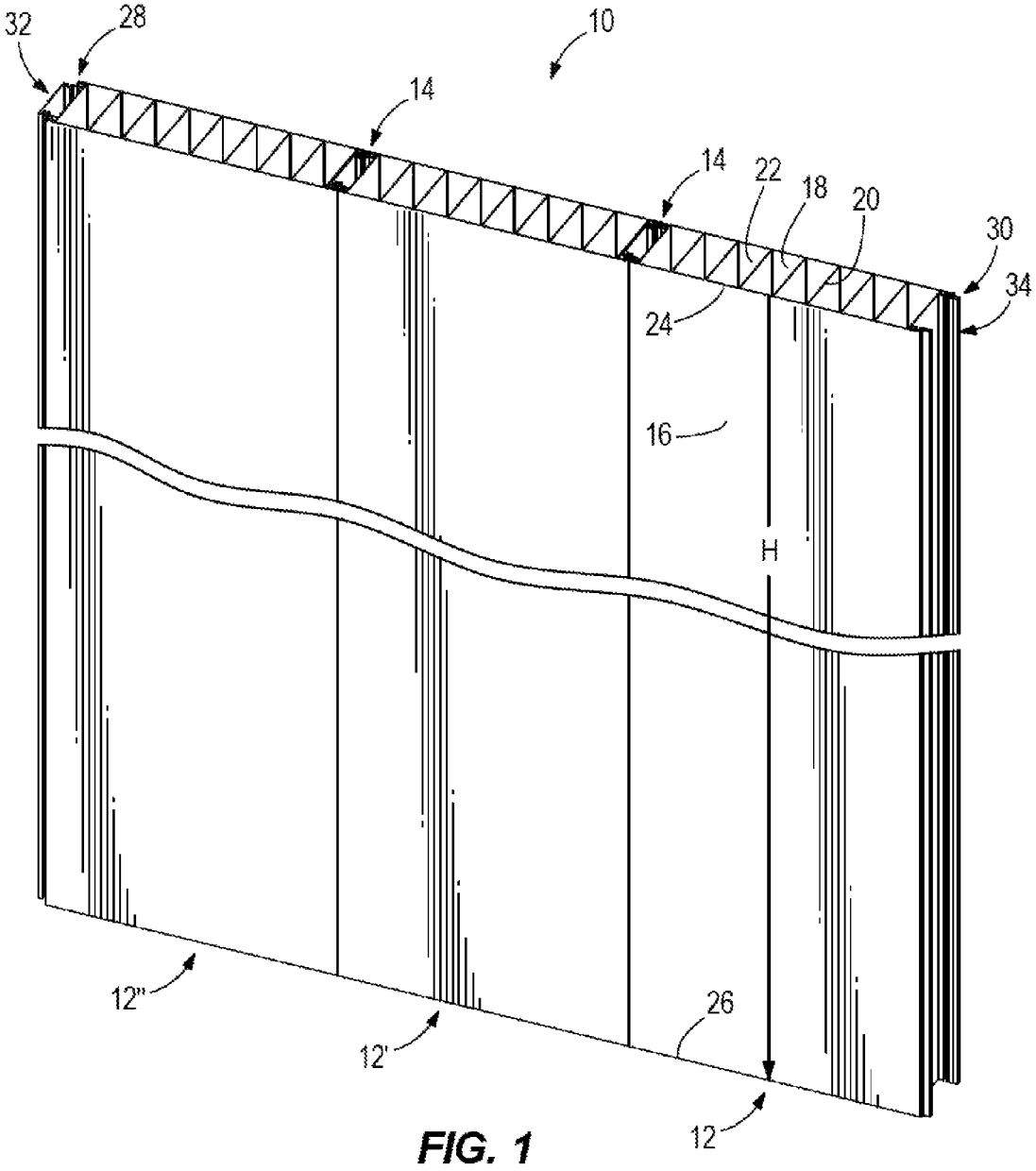
FIG. 1 is a front perspective view of an extruded wall panel system showing a number of adjacently disposed extruded plastic structural wall members interconnected together in accordance with the present disclosure.
Figure 2:
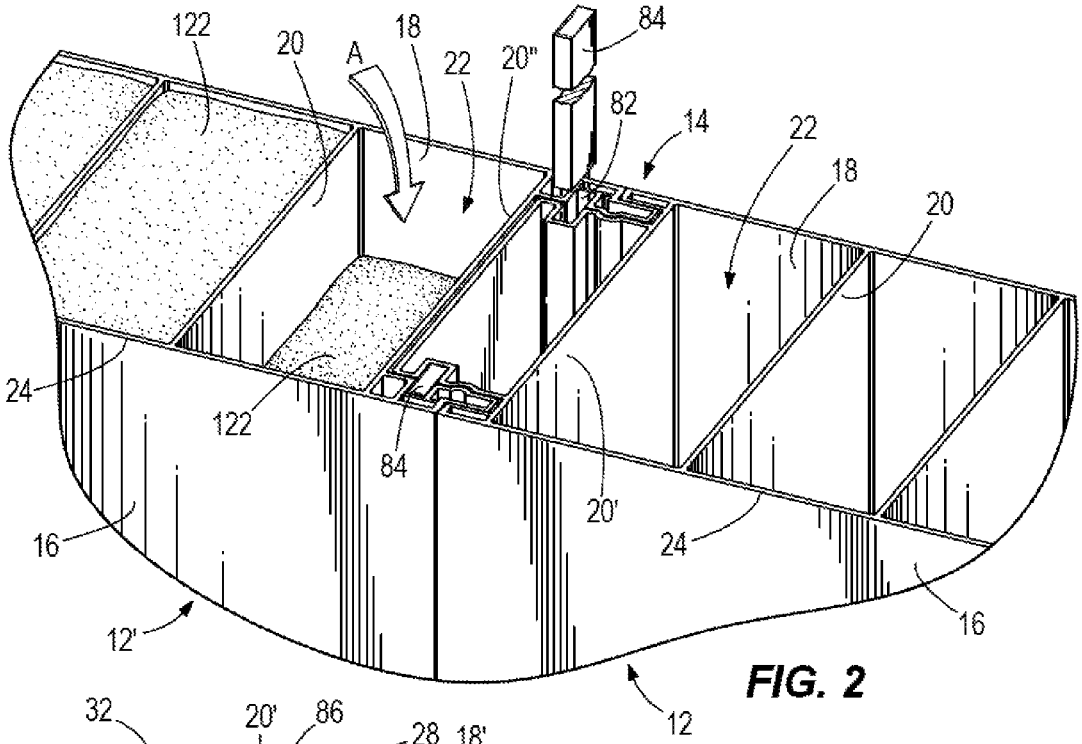
FIG. 2 is an enlarged detail view of the interconnection between two adjacently disposed wall members in FIG. 1 illustrating connecting structure integrally formed on adjacently disposed wall members of FIG. 1, and illustrating one of the connected wall members being filled with concrete.

Referring now to the drawings, FIGS. 1 and 2 illustrate various aspects of an extruded wall panel system 10 comprised a series of adjacently disposed extruded wall members 12, 12', 12" which are rigidly interconnected together at joints 14 along a straight line. Each of the wall members 12, 12', 12" is similarly constructed and includes a pair of spaced apart flat outer walls 16, 18 fixedly connected parallel to each other by a plurality of transverse solid webs or crosspieces 20 formed integrally therewith. The crosspieces 20 contribute significantly to the structural strength of each wall member 12, 12', 12", and facilitate the formation of internal cells or chambers 22 provided for a purpose to be described hereafter. Each crosspiece 20 typically extends along an entire height H of each wall panel 12, 12', 12" between respective top and bottom edges 24, 26 thereof.

Each of the wall members 12, 12', 12" is integrally formed of a rigid material, preferably extruded plastic, such as polyvinyl chloride (PVC) which is particularly desirable for use in buildings where moisture is prevalent and sanitation is important. The PVC material is extremely strong, lightweight, impervious to corrosive environments and easy to clean. Moreover, extruded plastic will not rust, rot, flake or require paint. While use of extruded plastic offers multiple advantages, it should be appreciated that other methods of forming and other materials for forming the wall members 12, 12', 12" are contemplated within the scope of this disclosure.

Figure 4:
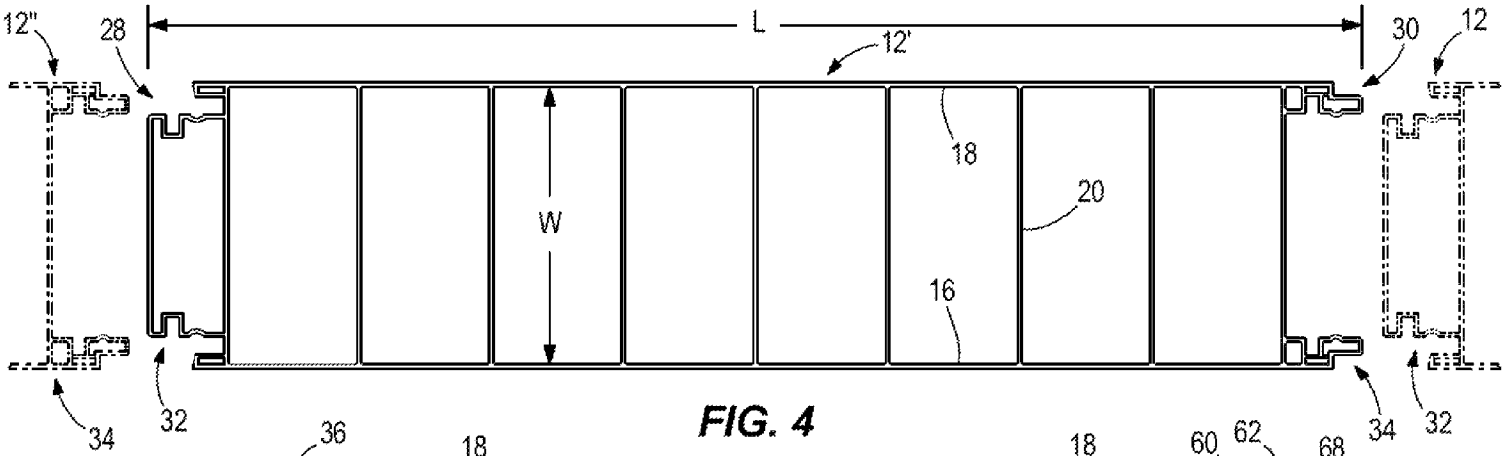
FIG. 4 is a top view of the center wall member shown in FIG. 1, and showing in phantom lines, connecting structure on the side edges of the adjacently disposed wall members adapted to be interconnected to the connecting structure on opposite side edges of the center wall member.

Each of the wall members 12, 12', 12", such as the center wall member 12' shown in FIG. 4, is similarly constructed at opposite side edges 28, 30 thereof with outwardly projecting male and female connecting structure 32, 34, respectively. As best seen in FIG. 1, the male and female connecting structure 32, 34 extends continuously along the vertical length of side edges 28, 30 on each of the wall members 12, 12', 12", and corresponds to the distance in height H between top and bottom edges 24, 26. Each wall member 12, 12', 12" is integrally formed with the connecting structure 32, 34, and is sized as desired with a height H as shown in FIG. 1, and an overall length L and width W as depicted in FIG. 4.

As will be more fully described hereafter, male and female connecting structure 32, 34 on facing opposite side edges 28, 30 of adjoining wall members 12, 12' and 12', 12" are provided with cooperating snap fit elements located separately from the outer walls 16, 18 and are designed to be matingly and frictionally coupled together in a direct snap fit engagement with one another to quickly effect interconnection at each joint 14.

Figure 4B:
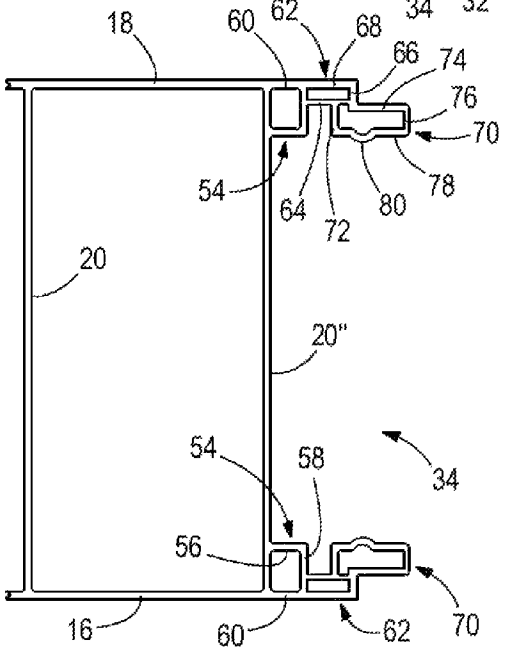
FIG. 4*b* is an enlarged detail view of the female connecting structure on the other side edge of the center wall member shown in FIG. 4.
Figure 4A:
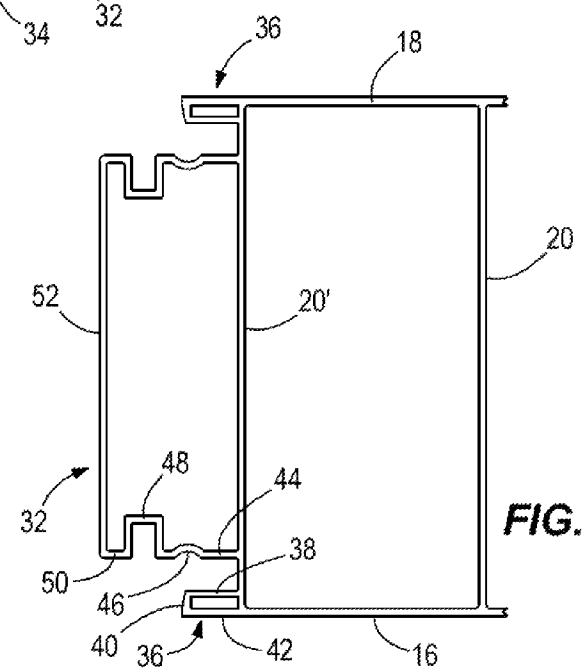
FIG. 4*a* is an enlarged detail view of a male connecting structure on one side edge of the center wall member in FIG. 4.

With further reference to FIG. 4 and FIG. 4*a*, the male connecting structure 32 located at side edge 28 includes a first pair of spaced tubular projections 36 that extend outwardly at the side edge 28 of outer walls 16, 18 from an end crosspiece 20' fixed thereto, and extend vertically along the height H of the outer walls 16, 18. The tubular projections 36 have inner surfaces 38, outer edges 40 and outer surfaces 42 which are coplanar with external surfaces of the outer walls 16, 18. The male connecting structure 32 further includes a pair of grooved walls 44 which extend outwardly from the end crosspiece 20' and form inwardly projecting depressions 46. The grooved walls 44 are spaced inwardly from the inner surfaces 38 of the tubular projections 36. Outer ends of the grooved walls 44 are joined to inwardly extending U-shaped channels 48 that have outwardly extending legs 50 joined by a planar end wall 52 which extends generally parallel to the end crosspiece 20. Together, the integrally formed grooved walls 44, channels 48, legs 50 and end wall 52 form a tubular protrusion extending vertically along the height H of the outer walls 16, 18, and having a width which is sized less than the width W between the outer walls 16, 18.

Referring to FIG. 4*b*, female connecting structure 34 located at the opposite side edge 30 includes a second pair of spaced tubular projections 54 that extend outwardly at the side edge 30 of outer walls 16, 18 from an end crosspiece 20" fixed thereto. The tubular projections 54 have inner surfaces 56, outer edges 58 an outer surfaces 60 that are coplanar with external surfaces of outer walls 16, 18. A third pair of tubular projections 62 extend outwardly from the tubular projections 54, and have inner surfaces 64, outer edges 66 and outer surfaces 68 that are coplanar with outer surfaces 60. A fourth pair of tubular projections 70 extend inwardly of the projections 62, and are formed with rear walls 72, outer surfaces 74, outer edges 76 and grooved inner walls 78 having inwardly extending nibs 80. Together, outer edges 58, inner surfaces 64 and rear walls 72 define outwardly extending U-shaped channels adapted to be aligned with the U-shaped channels 48 on male connecting structure 32 when adjacent wall members are interconnected.

The side edges 28, 30 with their male and female connecting structure 32, 34, respectively, are joined integrally with and extend beyond terminal edges of outer walls 16, 18, and aid in maintaining spacing therebetween by means of the end crosspieces 20', 20".

Figure 4C:
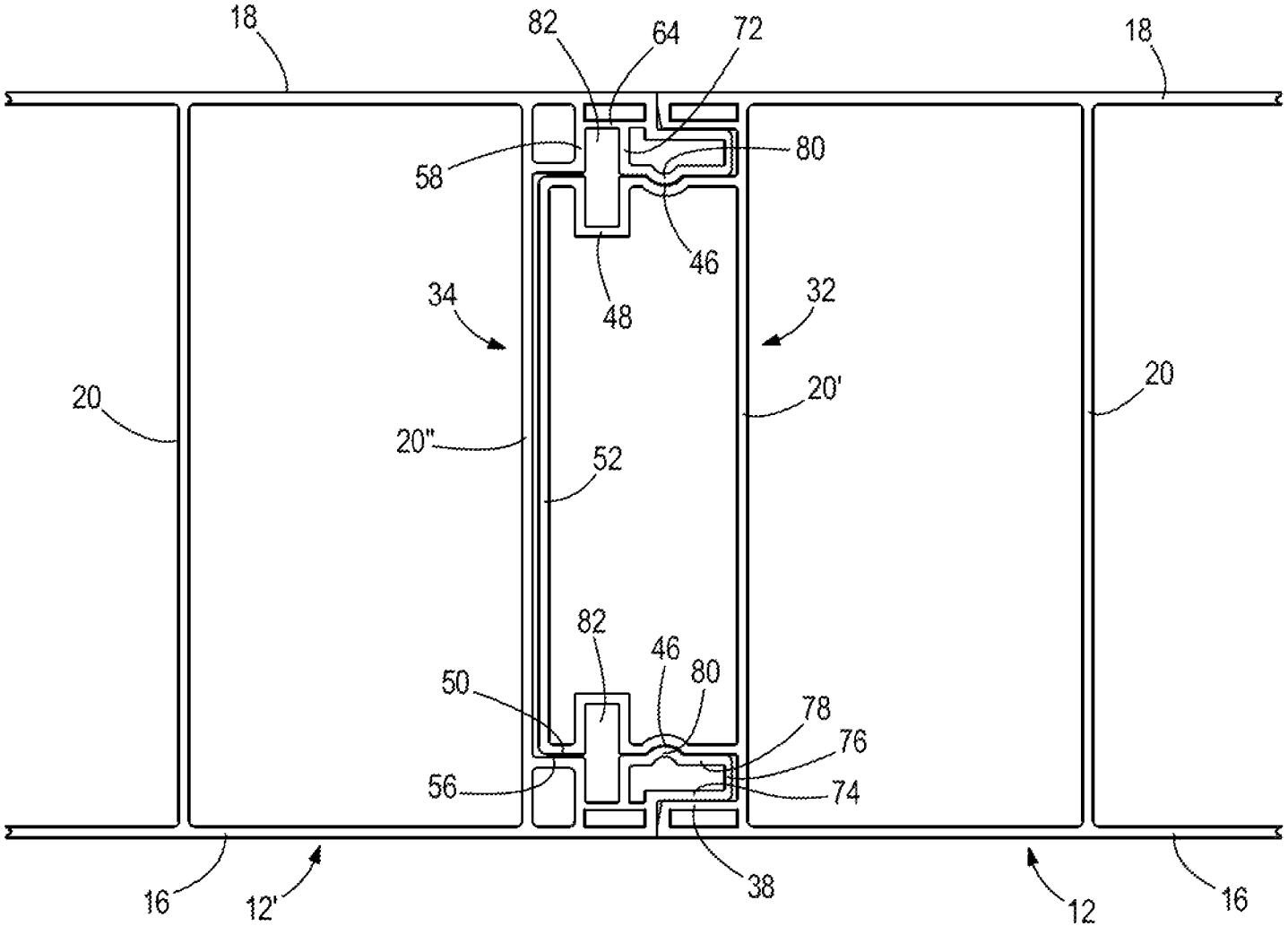
FIG. 4*c* is an assembled view of the connecting structure on one side edge of FIG. 4.

When it is desired to interconnect adjacently disposed wall members, such as wall members 12 and 12' (FIG. 2), the side edge 28 of the at least one of the wall members such as wall members 12, is moved laterally with a force in a horizontal motion towards the side edge 30 of wall member 12'. Such forced motion causes lateral sliding engagement of leading legs 50 along inner walls 78 over nibs 80 and along inner surfaces 56 until end wall 52 lies adjacent end crosspiece 20". At the same time, outer surfaces 74 slide along inner surfaces 38 until outer edges 76 lie adjacent end crosspiece 20'. Simultaneously, nibs 80 snap into the walls of depressions 46 so that the wall members 12, 12' are held in direct frictional engagement with each other as seen in FIG. 4*c*. It should also be appreciated that once the snapping frictional engagement between the mating male and female connecting structure 32, 34 has been attained, the U-shaped channels 48 and the U-shaped channels formed by outer edges 58, inner surfaces 64 and rear walls 72 are aligned to form a pair of passageways 82. These passageways 82 have a generally rectangular cross section for receiving and retaining a pair of elongated locking bars 84 that can be slidably inserted from the top of the adjoining wall members 12, 12' to positively secure and complete the joint 14 as shown in FIG. 2. The locking bars 84 are formed of a rigid material such as cellular PVC or aluminum. The same process is replicated to connect and secure other adjoining wall members such as 12', 12", together and create the wall panel system 10.

Figure 3:
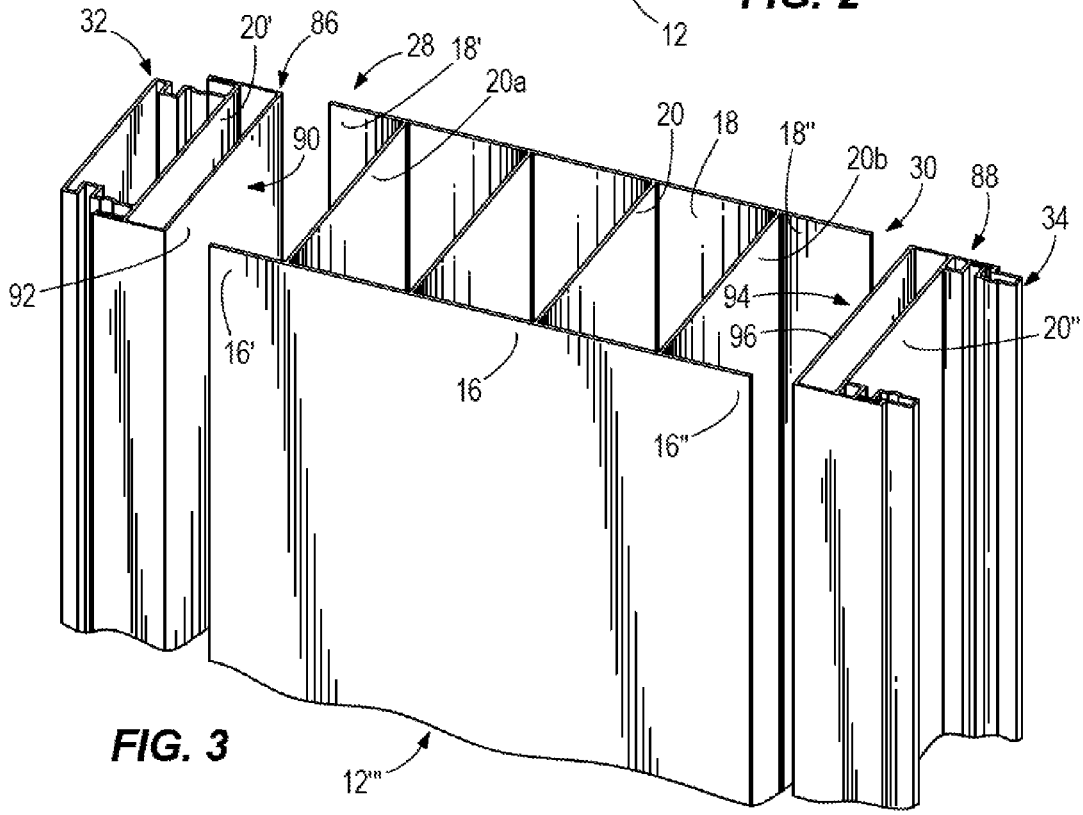
FIG. 3 is an exploded perspective view of an extruded plastic structural wall member provided with adapters defining connecting structure adapted to be received and retained within opposite side edges of the wall member.
Figure 5:
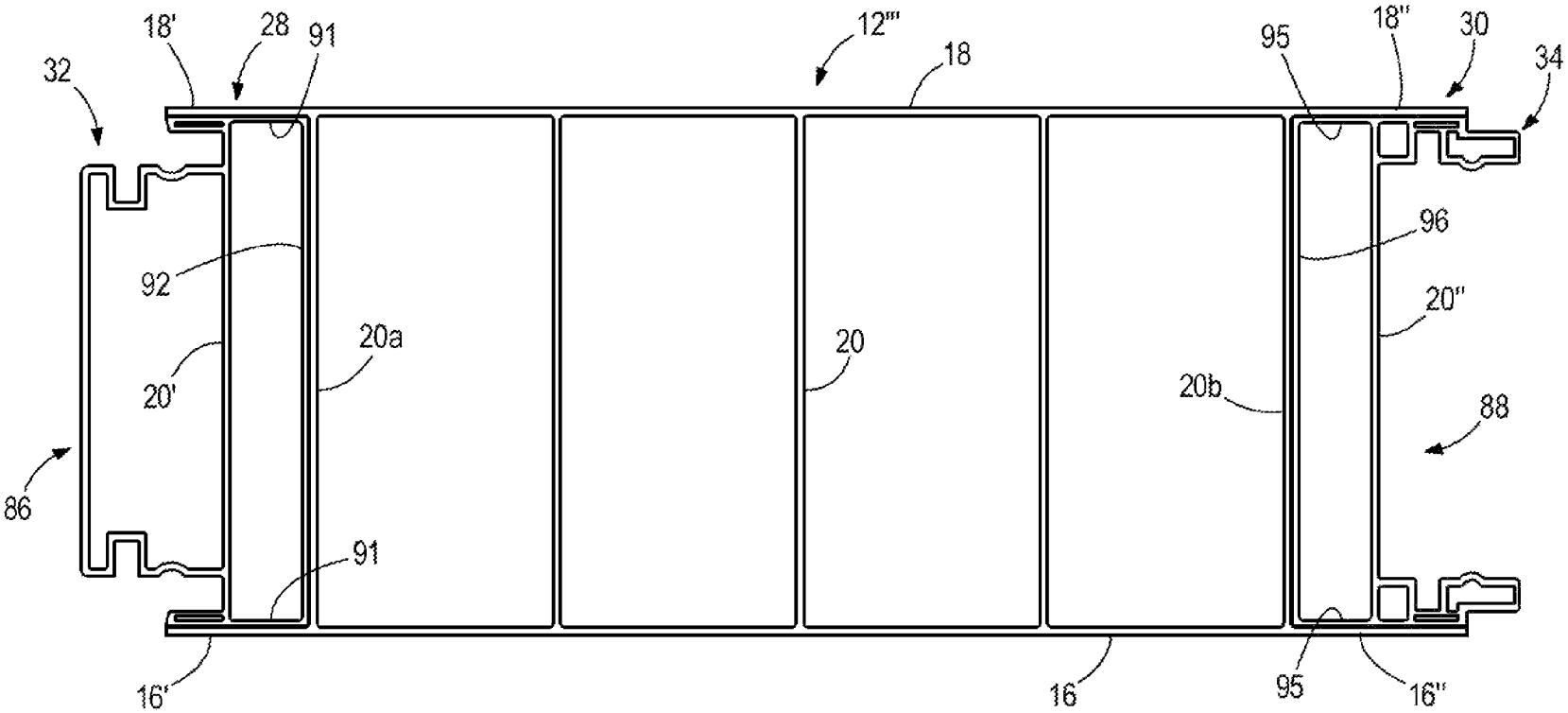
FIG. 5 is a top view of the assembled wall member shown in FIG. 3.

FIGS. 3 and 5 illustrate an alternative embodiment of a wall member 12'" having a length which is shorter than the length L of wall members 12, 12', 12". In this design, the end portions of wall members, such as 12, 12', or 12", are cutoff so as to form side edges 28, defined, respectively, by projecting sides 16', 18' of outer wall 16, 18 and crosspiece 20*a* fixed thereto, and projecting sides 16", 18" of outer walls 16, 18 and crosspiece 20*b* fixed thereto. A first adapter 86 incorporating the male connecting structure 32 as described above is attached within the side edge 28. A second adapter 88 incorporating female connecting structure 34 as described above is secured within the side edge 30. The first adapter 86 includes a U-shaped extension 90 having side walls 91 and an end wall 92 joined to crosspiece 20*a*. The second adapter 88 has a U-shaped extension 94 having side walls 95 and an end wall 96 fixed to crosspiece 20*b*. Wall member 12'" can be interconnected to a similar wall member such as 12, 12', 12" as previously described.

Figure 6:
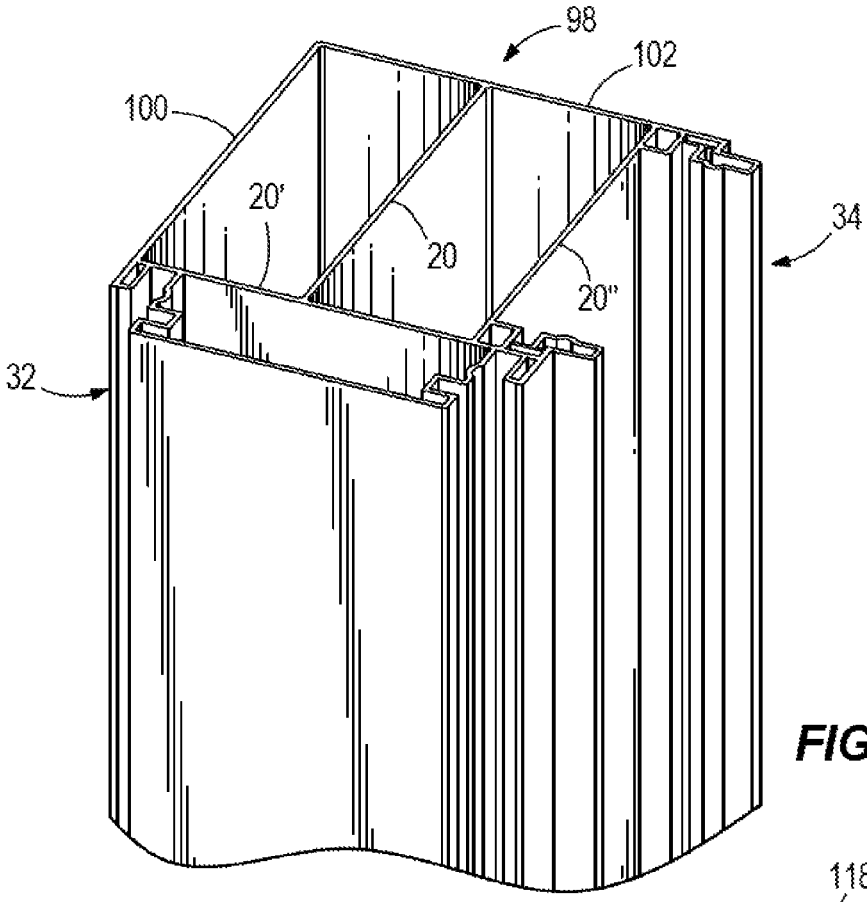
FIG. 6 is a perspective view of a corner member used in the extruded wall panel system.
Figure 9:
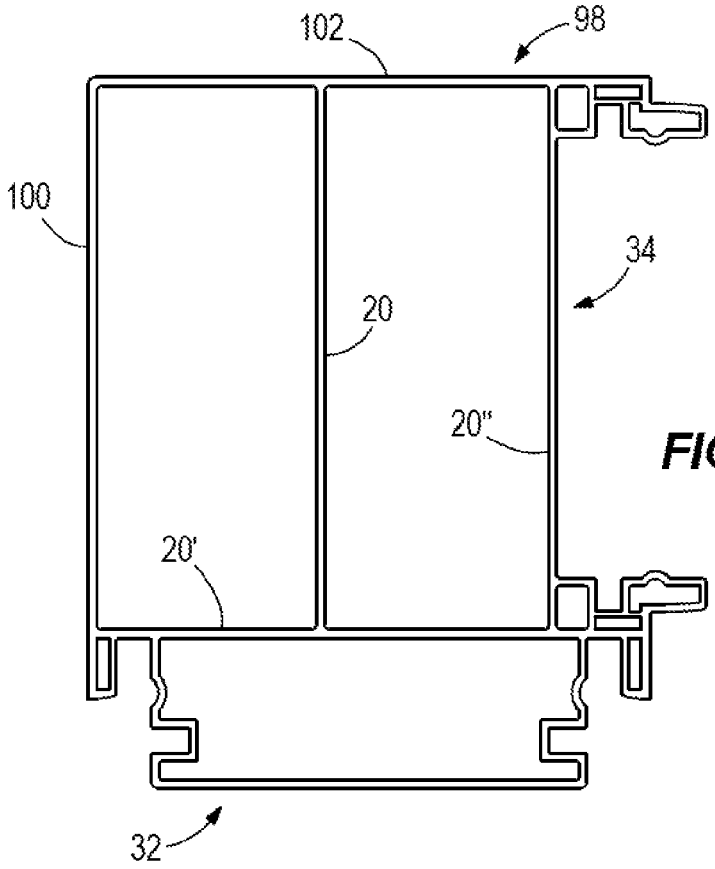
FIG. 9 is a top view of FIG. 6.

FIGS. 6 and 9 show a corner block member 98 used to interconnect wall members 12, 12', 12" at right angles in the wall panel system 10. The corner member 98 includes outer walls 100, 102 and crosspieces 20', 20" of male and female connecting structure 32, 34 which are joined perpendicularly to one another.

Figure 7:
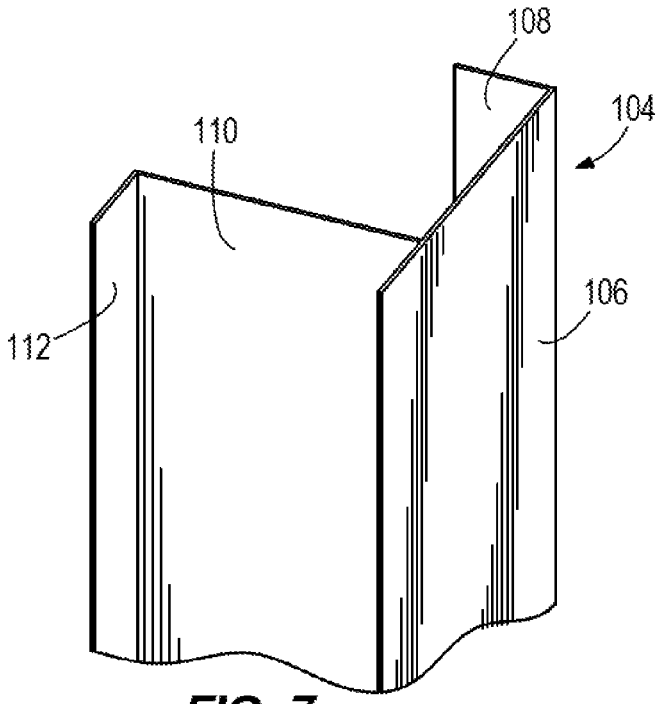
FIG. 7 is a perspective view of an alternative corner member to be used in the wall panel system.
Figure 10:
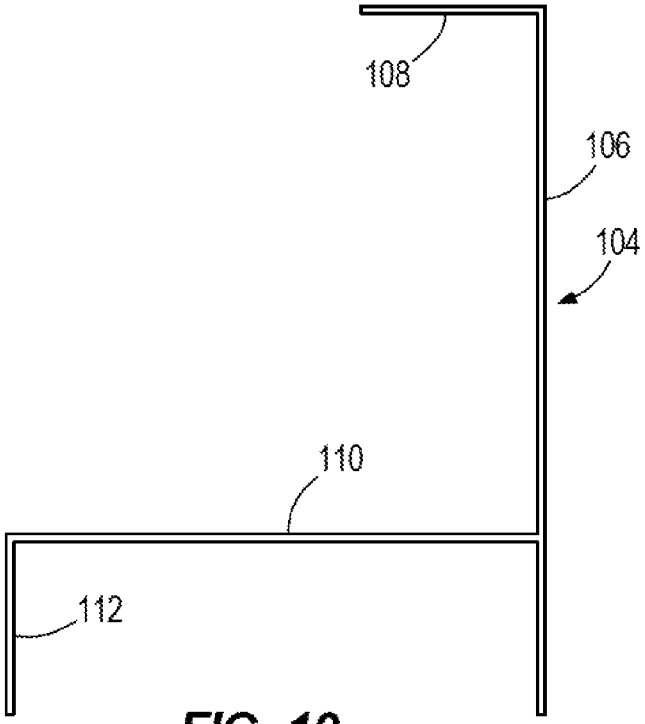
FIG. 10 is a top view of FIG. 7.

FIGS. 7 and 10 show a slip on corner member 104 for also interconnecting wall members 12, 12', 12" at right angles. The slip on corner member 104 is designed to frictionally cap or cover free side edges 28, 30 of the wall members 12, 12', 12" positioned at right angles. Corner member 104 is comprised of two L-shaped members joined substantially perpendicularly to one another, and includes end member 106 joined perpendicularly to a leg 108 and end member 110 joined substantially perpendicularly to a leg 112.

Figure 8:
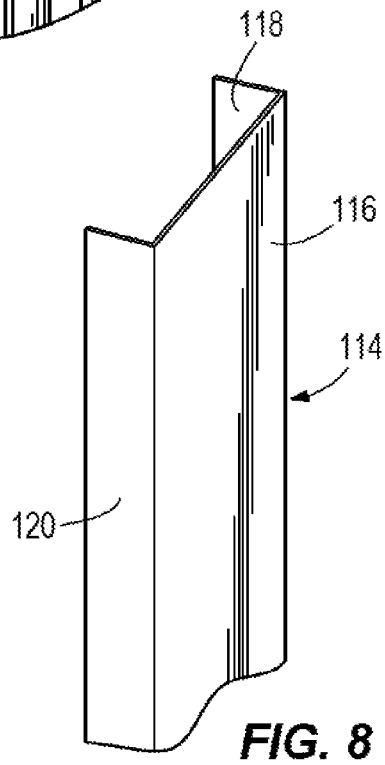
FIG. 8 is a perspective view of a cap to be used on a terminal side edge of a wall member in the wall panel system.
Figure 11:
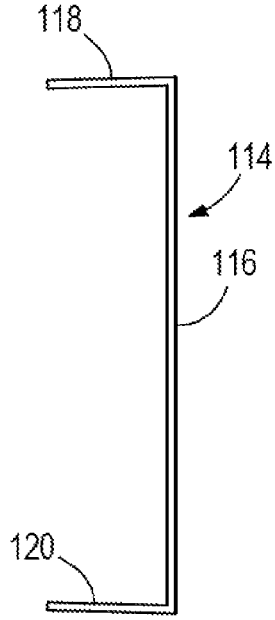
FIG. 11 is a top view of FIG. 8.

FIGS. 8 and 11 illustrate a U-shaped end cap 114 which is used to cover and close an exposed male or female connecting structure 32, 34. The end cap 114 has an end wall 116 and legs 118, 120 which are joined to the end wall 116 at angles slightly less than 90° so that the legs 118, 120 are frictionally engaged and retained on male or female connecting structure 32, 34 of wall members 12, 12', 12".

Figure 12:
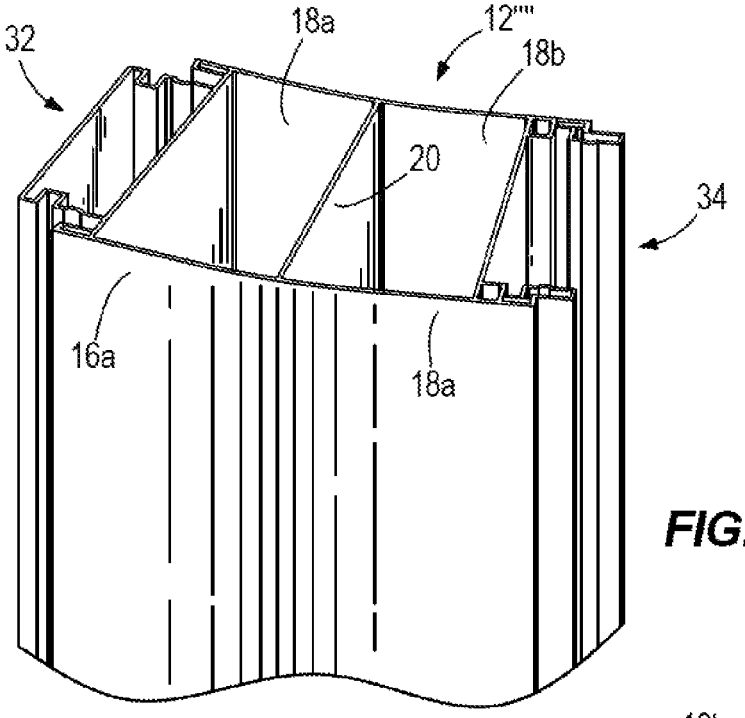
FIG. 12 is a perspective view of an angled wall member used to provide a generally curved segment of the wall panel system.
Figure 13:
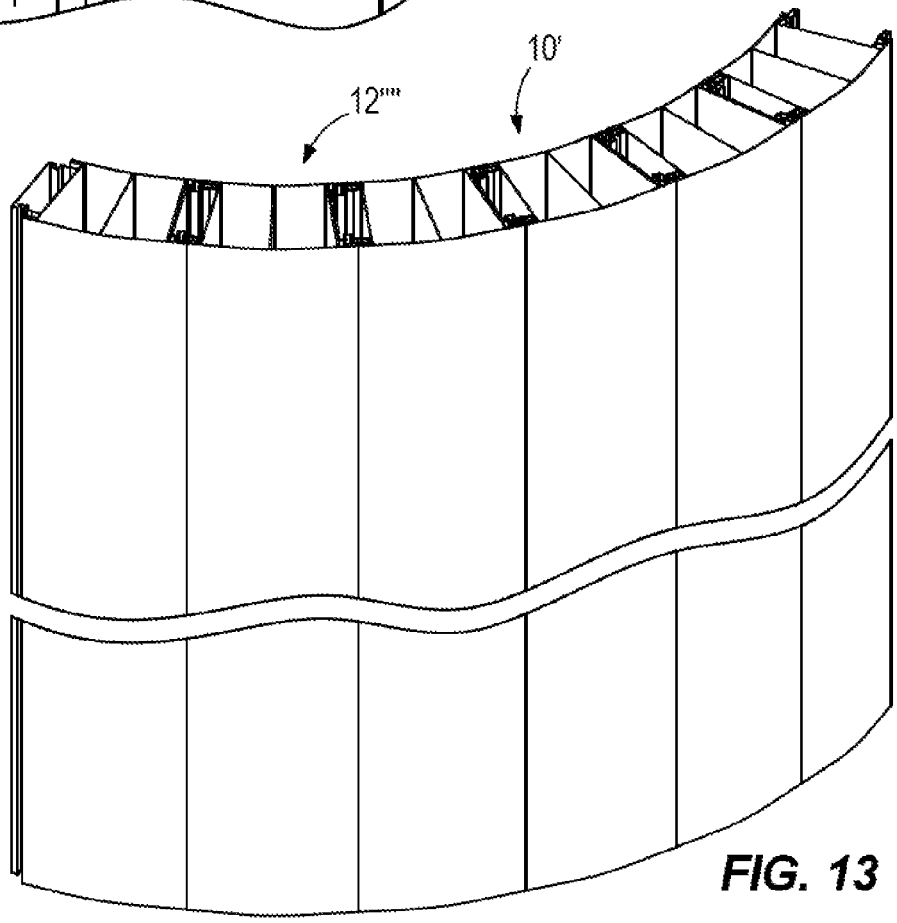
FIG. 13 is a perspective view of a generally curved segment of the wall panel system using adjacently disposed interconnected wall members of FIG. 12.
Figure 14:
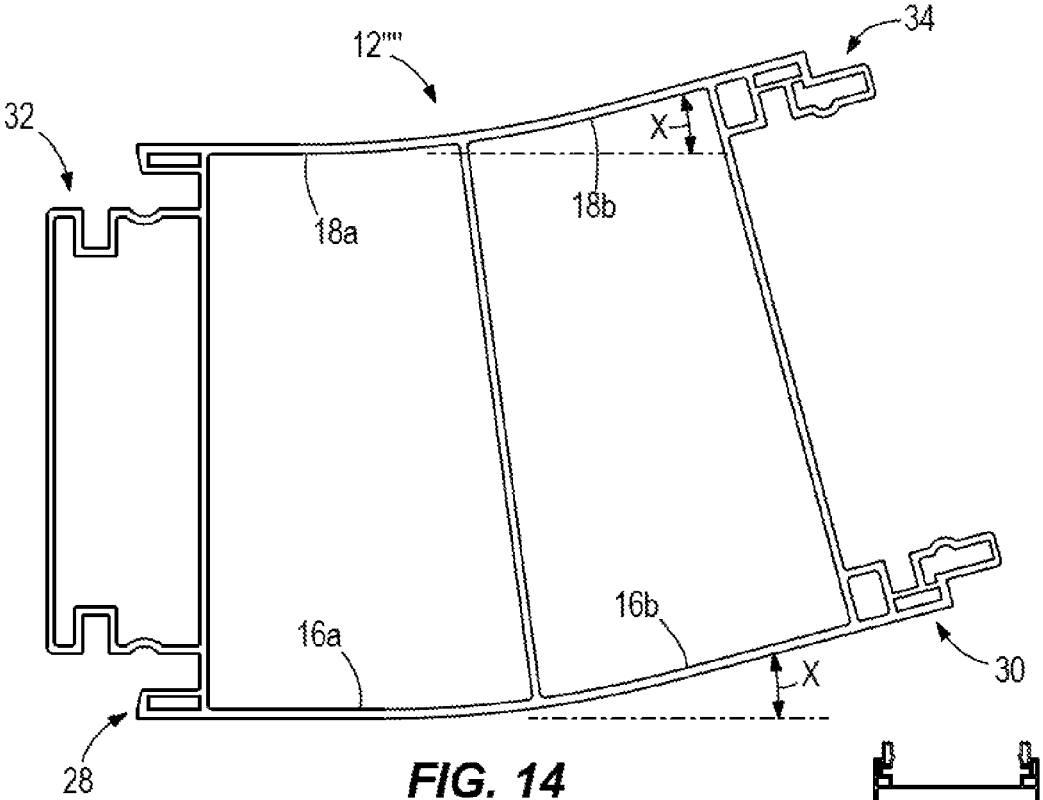
FIG. 14 is a top view of FIG. 12.
Figure 15:
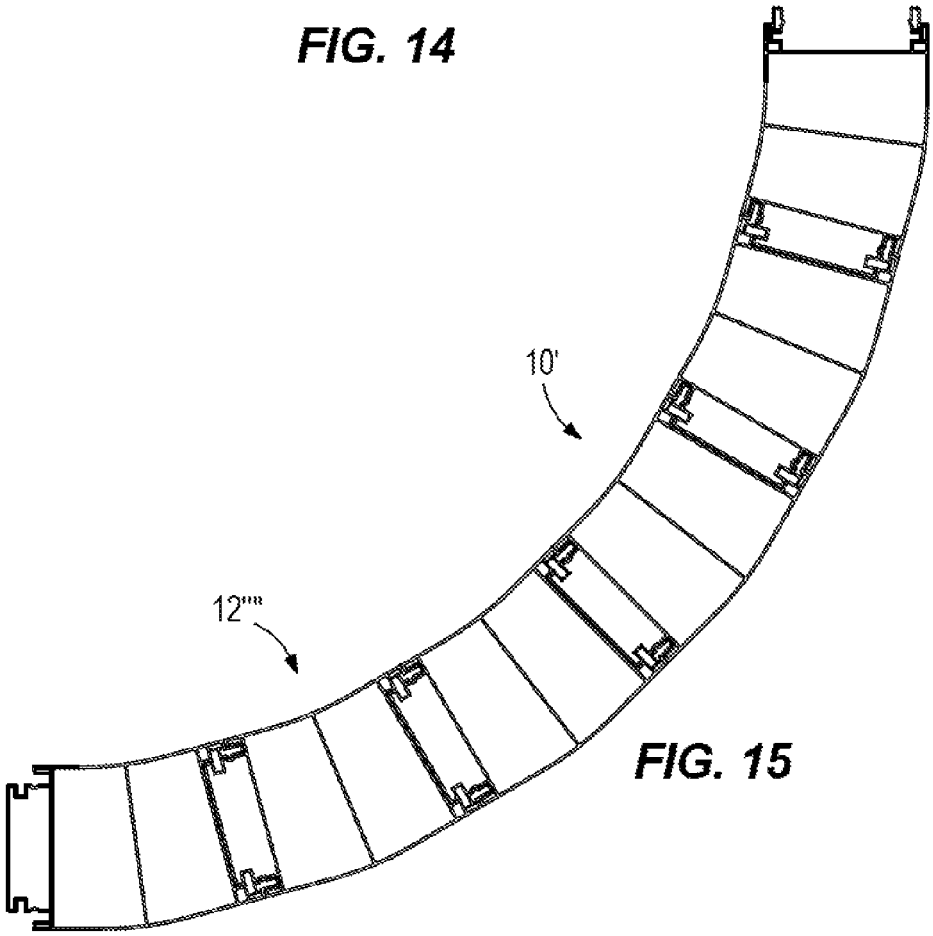
FIG. 15 is a top view of FIG. 13.

FIGS. 12 and 14 illustrate an angled wall member 12"" which is used to provide a generally curved segment of wall panel system 10' seen in FIGS. 13 and 15. As seen best in FIG. 14, the angled wall member 12"" includes a first outer wall segment 16*a* integrally connected to a second outer wall segment 16*b* which is formed at an acute angle x of about 15° relative to outer wall segment 16*a*. A third outer wall segment 18*a* is integrally connected to a fourth wall segment 18*b* formed at the same angle x of about 15° relative to outer wall segment 18*a*. Wall member 12"" includes male connecting structure 32 at one side edge 28 and female connecting structure 34 at the opposite side edge 30. A series of adjacently disposed wall members 12"" are interconnected and securely locked together as described above to form the curved segment shown in FIGS. 13 and 15.

It should be understood that once the joining wall members 12, 12', 12", 12'" and 12"" have been interconnected at secure joints 14 as described above, the formed wall panel systems 10, 10' may be reinforced. An example of such reinforcement is shown in FIG. 2 wherein a flowable material such as concrete 122 is added to the internal chambers 22 form the top thereof as represented by arrow A. Other flowable materials such as sand, gravel or foam insulation may also be added to the chambers 22 as desired.

The present disclosure thus provides a wall panel system 10, 10' comprised of adjacently disposed wall members 12, 12', 12", 12'" and 12"" which are assembled together without tools and fasteners by means of a lateral snap fit direct engagement of mating male and female connecting structure 32, 34 on facing side edges 28, 30 of the adjoining wall members, and then positively secured in a joint 14 by the insertion of locking bars 84.

In contrast with interconnected wall panel systems of the prior art, the present disclosure provides a joint arrangement which is more quickly and simply connected together and more user friendly at a job site because precise spacing between the side edges of the adjoining wall members is not required. The present wall panel system has been found to reduce construction time and labor costs. In addition, the joint arrangement enabled by the present disclosure provides a wall member interconnection that is internal to and completely concealed with the formed wall panel system 10, 10' resulting in less seams therein and an improved smooth exterior appearance.

The wall panel system 10, 10' of the present disclosure, when formed from extruded plastic, is particularly useful in the fields of agriculture, food processing, cold storage, laboratories, and vehicle wash facilities where sanitation, low maintenance, durability and a clean appearance are desired. However, the wall panel system 10, 10' is not limited to these applications, and may have utility in other building construction.

Various alternatives are contemplated as being within the scope of the following claims particularly pointing out and distinctly claiming the subject matter regarded as the invention.

What is claimed is:

1. A wall member useful in forming a wall panel system comprising:

a pair of outer walls spaced apart and fixed together by end crosspieces at a pair of opposed side edges, one of the side edges being provided with a first connecting structure and the other of the side edges being provided with a second connecting structure which is structurally different than the first connecting structure, wherein the first and second connecting structure includes a number of tubular projections secured to and extending outwardly from the side edges and the end crosspieces, and constructed with snap fit elements that are separately located from the outer walls, and defined by grooved walls forming engagement surfaces of the tubular projections and located outwardly of the end crosspieces; and whereby the wall member is adapted to be joined to an adjacently disposed wall member of similar structure by direct snap fit mating engagement between one of the first and second connecting structure at one of the side edges of the wall member and the other of the first and second connecting structure on a facing side edge of the adjacently disposed wall member.

2. The wall member of claim 1, wherein the first connecting structure is a male connecting structure, and the second connecting structure is a female connecting structure.

3. The wall member of claim 1, wherein the outer walls are held in spaced relationship by a series of spaced apart crosspieces extending across and defining internal chambers between the outer walls.

4. The wall member of claim 1, wherein the outer walls and the first and second connecting structure are formed from extruded plastic.

5. The wall member of claim 1, wherein the first and second connecting structure extends vertically between top and bottom edges of the outer walls.

6. The wall member of claim 1, wherein the first connecting structure includes a pair of spaced tubular projections that extend outwardly at the one side edge from a first end crosspiece fixedly joining the outer walls.

7. The wall member of claim 6, wherein the first pair of tubular projections have inner surfaces, outer edges and outer surfaces joined to each other, the outer surfaces being coplanar with external surfaces of the outer walls.

8. The wall member of claim 7, wherein the first connecting structure further includes a pair of grooved walls extending outwardly from the first end crosspiece and forming inwardly projecting depressions.

9. The wall member of claim 1, wherein the second connecting structure includes a second pair of tubular projections that extend at the other side edge from a second end crosspiece fixedly joining the outer walls.

10. The wall member of claim 9, wherein the second pair of tubular projections have inner surfaces, outer edges and outer surfaces connected together, the outer surfaces being coplanar with external surfaces of the outer walls.

11. The wall member of claim 1, wherein the outer walls are flat between the opposed side edges.

12. The wall member of claim 1, wherein the outer walls are each comprised of a first flat wall segment integrally joined to a second wall segment that is angled relative to the first wall segment.

13. The wall member of claim 1, wherein the first connecting structure and the second connecting structure are integrally formed at the opposed side edges.

14. The wall member of claim 1, wherein the first and second connecting structure are provided in the form of adapters which are separately connected at the opposed side edges.

15. The wall member of claim 1, wherein the grooved walls on the tubular projections are constructed with engagement surfaces in the form of nibs facing each other, and walls forming depressions facing away from each other.

16. A wall panel system comprising:

a first wall member having a pair of outer walls held spaced apart and fixed together at a pair of opposed side edges, one of the side edges being provided with a male connecting structure and the other of the side edges being provided with a female connecting structure;

a second wall member having a pair of outer walls held spaced apart and fixed together at a pair of opposed side edges, one of the side edges being provided with a male connecting structure and the other of the side edges being provided with a female connecting structure;

wherein the male and female connecting structure is constructed with snap fit elements separately located from the outer walls of the first and second wall members; and wherein the first wall member is positioned adjacent the second wall member such that with one pair of the side edges of the first and second wall members facing each other, one of the male and female connecting structure at the facing side edge of the first wall member is movable into direct snap fit mating engagement with the other of the male and female connecting structure on the facing side edge of the second wall member to form an interconnection between the first and second wall members; and wherein the female connecting structure is constructed with nibs that are engageable in the snap fit engagement with walls of depressions formed in the male connecting structure.

17. The wall panel system of claim 16, wherein the interconnection formed by the engaged male and female connecting structure defines a passageway arrangement for receiving a locking bar structure to positively lock the first and second wall members together.

18. The wall panel system of claim 16, wherein the interconnection formed by the engaged male and female connecting structure is concealed from exterior surfaces of the connected first and second wall members and lies completely between the connected first and second wall members.

19. A method of forming a wall panel system comprising the steps of:

a) providing a first wall member having a pair of outer walls held spaced apart and fixed together by end crosspieces at a pair of opposed side edges, one of the side edges being provided with a male connecting structure and the other of the side edges being provided with a female connecting structure, the male and female connecting structure being constructed with tubular projections extending outwardly from the end crosspieces and having snap fit elements separately located from the outer walls and defined by grooved walls forming engagement surfaces of the projections and located outwardly of the end crosspieces;

b) providing a second wall member having a pair of outer walls held spaced apart and fixed together by end crosspieces at a pair of opposed side edges, one of the side edges being provided with a male connecting structure and the other of the side edges being provided with a female connecting structure, the male and female connecting structure being constructed with tubular projections extending outwardly from the end crosspieces and having snap fit elements separately located from the outer walls defined by grooved walls forming engagement surfaces of the projections and located outwardly of the end crosspieces;

c) positioning the first and second wall members adjacent each other such that one pair of the side edges of the first and second wall members face each other; and d) slidably forcing one of the male and female connecting structure at the facing side edge of the first wall member into direct snap fit mating engagement with the other of the male and female connecting structure on the facing side edge of the second wall member such that the grooved walls on the tubular projections of the first wall member slide along the grooved walls on the tubular projections of the second wall member causing the engagement surfaces to enter into the direct snap fit engagement to form an interconnection between the first and second wall members.

20. The method of claim 19, wherein the formed interconnection between the first and second wall members defines a passageway arrangement.

21. The method of claim 20, further comprising the step of inserting locking bar structure into the passageway arrangement to secure the formed interconnection between the first and second wall members.

22. The method of claim 19, wherein the outer walls of the first and second wall members are provided with a plurality of crosspieces which form internal chambers between the outer walls.

23. The method of claim 22, further comprising the step of adding a flowable material to at least one of the internal chambers after the first and second wall members are interconnected together.

24. A wall member useful in forming a wall panel system comprising:

a pair of outer walls spaced apart and fixed together at a pair of opposed side edges, one of the side edges being provided with a first connecting structure and the other of the side edges being provided with a second connecting structure which is structurally different than the first connecting structure, wherein the first and second connecting structure includes a number of projections secured to and extending outwardly from the side edges and constructed with snap fit elements that are separately located from the outer walls, and whereby the wall member is adapted to be joined to an adjacently disposed wall member of similar structure by direct snap fit mating engagement between one of the first and second connecting structure at one of the side edges of the wall member and the other of the first and second connecting structure on a facing side edge of the adjacently disposed wall member, wherein the first connecting structure includes a pair of spaced tubular projections that extend outwardly at the one side edge from a first end crosspiece fixedly joining the outer walls, wherein the pair of tubular projections have inner surfaces, outer edges and outer surfaces joined to each other, the outer surfaces being coplanar with external surfaces of the outer walls, wherein the first connecting structure further includes a pair of grooved walls extending outwardly from the first end crosspiece and forming inwardly projecting depressions, and wherein outer ends of the grooved walls are joined to inwardly extending U-shaped channels that have outwardly extending legs connected by an end wall extending generally parallel to the first end crosspiece.

25. A wall member useful in forming a wall panel system comprising:

a pair of outer walls spaced apart and fixed together at a pair of opposed side edges, one of the side edges being provided with a first connecting structure and the other of the side edges being provided with a second connecting structure which is structurally different than the first connecting structure, wherein the first and second connecting structure includes a number of projections secured to and extending outwardly from the side edges and constructed with snap fit elements that are separately located from the outer walls, and whereby the wall member is adapted to be joined to an adjacently disposed wall member of similar structure by direct snap fit mating engagement between one of the first and second connecting structure at one of the side edges of the wall member and the other of the first and second connecting structure on a facing side edge of the adjacently disposed wall member, wherein the second connecting structure includes one pair of tubular projections that extend at the other side edge from a second end crosspiece fixedly joining the outer walls, wherein the one pair of tubular projections have inner surfaces, outer edges and outer surfaces connected together, the outer surfaces being coplanar with external surfaces of the outer walls, and wherein another pair of tubular projections extend outwardly from the one pair of tubular projections and have inner surfaces, outer edges and outer surfaces joined together.

26. The wall member of claim 25, wherein a fourth pair of tubular projections extend inwardly from the third pair of tubular projections and are formed with rear walls, outer surfaces, outer edges and grooved inner walls having inwardly extending nibs formed thereon.

27. The wall member of claim 26, wherein the second connecting structure has outwardly extending U-shaped channels formed therein.

* * * * *